US009010443B2

(12) United States Patent
Sredensek

(10) Patent No.: US 9,010,443 B2
(45) Date of Patent: Apr. 21, 2015

(54) SLIP BOWL LOAD TRANSFER SYSTEM

(75) Inventor: Herwig Michael Sredensek, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 668 days.

(21) Appl. No.: 13/307,705

(22) Filed: Nov. 30, 2011

(65) Prior Publication Data

US 2013/0133900 A1 May 30, 2013

(51) Int. Cl.
*E21B 19/10* (2006.01)
*E21B 19/07* (2006.01)

(52) U.S. Cl.
CPC ..... *E21B 19/10* (2013.01); *E21B 19/07* (2013.01)

(58) Field of Classification Search
CPC ..... E21B 19/06; E21B 19/07; E21B 19/10
USPC ..... 166/77.4, 77.52, 77.53
See application file for complete search history.

(56) References Cited

U.S. PATENT DOCUMENTS 3,096,075 A * 7/1963 Brown ..... 254/29 R
3,797,570 A 3/1974 Leutwyler
RE30,070 E 8/1979 Sizer et al. ..... 166/72
4,676,312 A * 6/1987 Mosing et al. ..... 166/77.53
4,715,456 A 12/1987 Poe et al.
5,732,909 A * 3/1998 Sonnier ..... 248/49
5,791,410 A * 8/1998 Castille et al. ..... 166/77.1
5,909,768 A * 6/1999 Castille et al. ..... 166/77.1
6,688,393 B2 2/2004 Sredensek et al. ..... 166/377
6,820,705 B2 11/2004 Baugh ..... 175/423
7,086,461 B2 * 8/2006 Schulze-Beckinghausen et al. ..... 166/77.53
7,134,531 B2 11/2006 Ramey et al. ..... 188/67

OTHER PUBLICATIONS

International Search Report and Written Opinion issued in PCT/US2012/064655, mailed Dec. 20, 2013, 10 pages.

* cited by examiner

*Primary Examiner* — Giovanna C Wright
(74) *Attorney, Agent, or Firm* — Anthony P. Iannitelli; Baker Botts L.L.P.

(57) ABSTRACT

A slip bowl load transfer system includes a first slip bowl assembly and a second slip bowl assembly. The first slip bowl assembly, adapted to engage and release a tubular member, includes a first slip bowl coupled to a second slip bowl. In an engaged state, the first slip bowl assembly imparts a compressive force on a portion of the tubular member between the first slip bowl and the second slip bowl. The second slip bowl assembly is adapted to engage and release the tubular member and is aligned with the first slip bowl assembly. When the second slip bowl assembly is engaging the tubular member in a second engaged state, the second slip bowl assembly is prevented from releasing the tubular member if the first slip bowl assembly is not in the engaged state.

17 Claims, 3 Drawing Sheets

SLIP BOWL LOAD TRANSFER SYSTEM

BACKGROUND

The present disclosure relates generally to wellbore operations and, more particularly, to a slip bowl load transfer system.

In oil and gas well operations, long strings of tubular members, such as pipes, are inserted into and removed from wells at various times. When tubular members are inserted into a well, a tubular member is attached to the top of a tubular string and the string is lowered into the well. When tubular members are removed from a well, a tubular member is removed from the top of a tubular string and the string is raised from the well. Depending on the depth of a well, a string of tubular members may be thousands of feet long and many tubular members may need to be attached to or removed from the string to complete an operation. Particularly in snubbing and heavy workover operations, operator error, or mechanical malfunction of the slip bowls can cause the tubular member to either fall into the wellbore or be ejected from the wellbore, depending on tubular load direction. And consequences of slip bite failure can be very serious.

Therefore, it would be desirable to be able to minimize operator error and to improve the safety involved in attaching or removing tubular members in such operations.

SUMMARY

The present disclosure relates generally to wellbore operations and, more particularly, to a slip bowl load transfer system.

In one aspect, a slip bowl load transfer system is disclosed. A first slip bowl assembly, adapted to engage and release a tubular member, includes a first slip bowl coupled to a second slip bowl. In an engaged state, the first slip bowl assembly imparts a compressive force on a portion of the tubular member between the first slip bowl and the second slip bowl. A second slip bowl assembly is adapted to engage and release the tubular member and is aligned with the first slip bowl assembly. When the second slip bowl assembly is engaging the tubular member in a second engaged state, the second slip bowl assembly is prevented from releasing the tubular member if the first slip bowl assembly is not in the engaged state. In another aspect, a method of transferring a load is disclosed. The method includes: providing a first slip bowl assembly adapted to engage and release a tubular member and including a first slip bowl coupled to a second slip bowl; imparting a compressive force on a portion of the tubular member with the first slip bowl assembly in an engaged state; and providing a second slip bowl assembly adapted to engage and release the tubular member and that is aligned with the first slip bowl assembly. When the second slip bowl assembly is engaging the tubular member in a second engaged state, the second slip bowl assembly is prevented from releasing the tubular member if the first slip bowl assembly is not in the engaged state. The method further includes releasing the tubular member from the second slip bowl assembly.

The features and advantages of the present invention will be apparent to those skilled in the art. While numerous changes may be made by those skilled in the art, such changes are within the spirit of the invention.

BRIEF DESCRIPTION OF THE DRAWINGS

Some specific exemplary embodiments of the disclosure may be understood by referring, in part, to the following description and the accompanying drawings.

Figure 1:
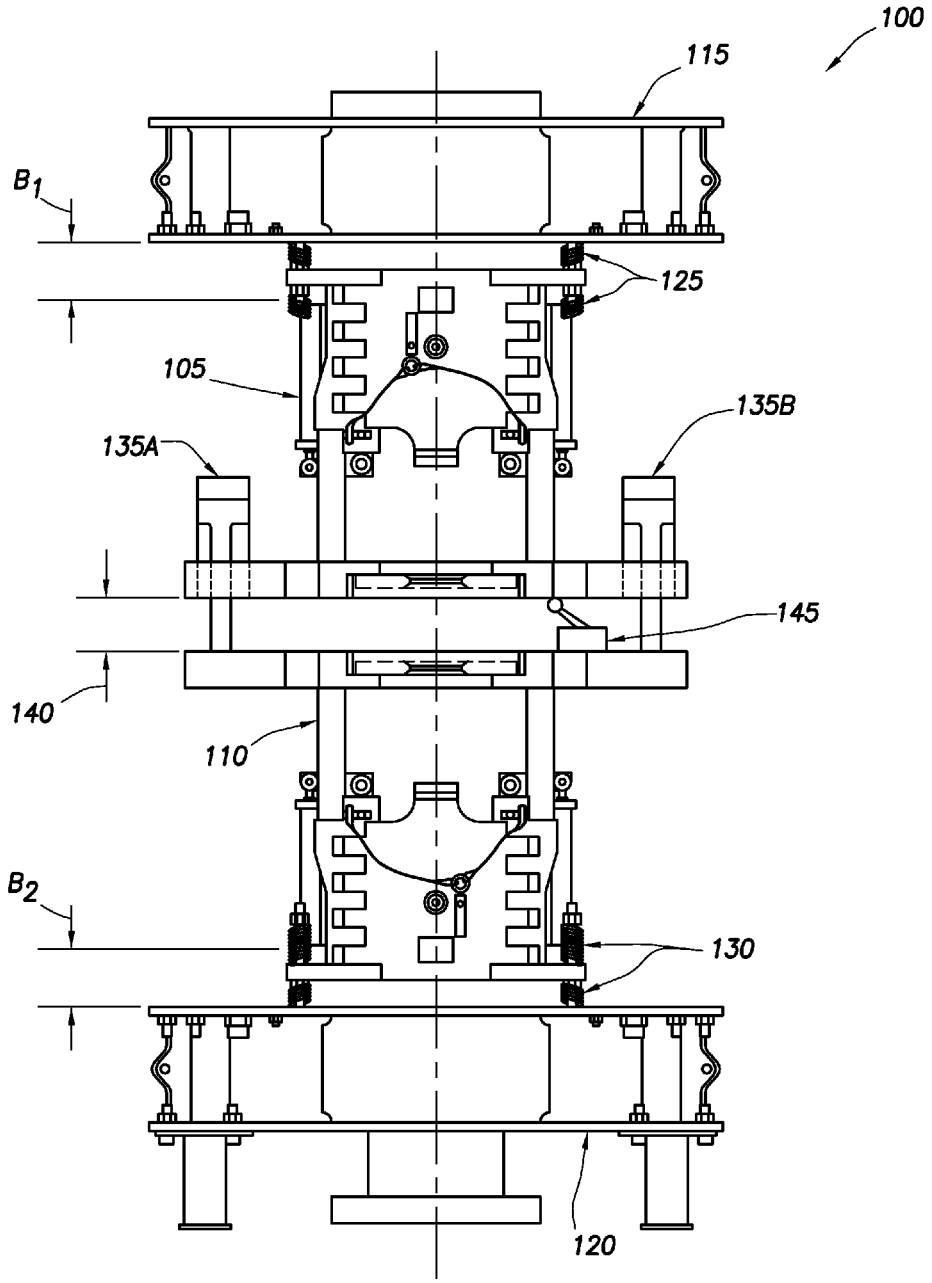
FIG. 1 is an illustration of an example slip bowl assembly, in accordance with certain embodiments of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to wellbore operations and, more particularly, to a slip bowl load transfer system.

Illustrative embodiments of the present disclosure are described in detail herein. In the interest of clarity, not all features of an actual implementation may be described in this specification. It will of course be appreciated that in the development of any such actual embodiment, numerous implementation specific decisions must be made to achieve the specific implementation goals, which will vary from one implementation to another. Moreover, it will be appreciated that such a development effort might be complex and time consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, or otherwise nonlinear wellbores in any type of subterranean formation. Embodiments may be applicable to injection wells as well as production wells, including hydrocarbon wells.

A typical slip bowl may be hydraulically opened under low pipe load conditions, thus releasing the pipe load engaged by the slip bowl. Snubbing and hydraulic workover unit operators typically follow a load transfer procedure to transfer a pipe load from an active slip bowl to another slip bowl (e.g., traveling slips to stationary slips) before opening the active slip bowl. Operator error, slip bowl mechanical malfunction, or insufficient slip grip are a few examples of potential faults that can lead the operator to inadvertently open the active slip bowl, before load transfer has taken place—thereby releasing the pipe load. And, depending on pipe load direction, the pipe can either fall into the wellbore or be ejected from the wellbore. At moderate to high pipe loads, typical slip bowls may have a mechanical disadvantage that prevents the active slip bowl from being opened in case load transfer has not taken place to a second slip bowl. As pipe load on the slips approaches zero when approaching the balance point, there is less pipe load to positively set the slips to bite on the pipe outer diameter. Low setting force increases the possibility of improper bite when a slip bowl is closed. The risk of improper bite increases with pipe yield grade and surface hardness of the pipe being run.

Certain embodiments according to the present disclosure prevent two slip bowls for handling tubular members, such as pipe, from being actuated to the open position at the same time. Certain embodiments provide for such prevention even in the case of the operator actuating both slip bowls quickly, i.e., both slip bowls momentarily open at the same time during the processes of opening and closing. Certain embodiments provide for confirmation that a load transfer has taken place before allowing another slip bowl to be opened. Certain embodiments provide improved tubular load control through the balance point of pipe tubular and the balance point zone via a preload bite on the tubular. In certain embodiments, the balance point zone may be defined to include a load range from zero pipe load (force) to the maximum pipe load a slip bowl can release via actuation of the slip bowl's hydraulic (or otherwise) actuating cylinder. The balance point zone may be unique to one or more types of slip bowl design. Certain embodiments may prevent slip bite failure. Certain embodiments hold a tubular load in both longitudinal directions (e.g., up and down in the case of a vertical tubular load).

FIG. 1 is an illustration of one example slip bowl assembly 100, in accordance with certain embodiments of the present disclosure. The system 100 may include two opposing slip bowls 105 and 110, each adapted to engage and release a tubular member, such as a pipe (not shown), along the longitudinal axis of the system 100. The slip bowls 105 and 110 may include any suitable slip bowls, including one or more conventional slips, operable to engage or release a tubular and adapted for the load transfer features described herein. Each slip may be configured to engage a tubular member with a bite biased in a longitudinal direction of the tubular. And, in the opposing relationship, the slip bowls 105 and 110 may be configured to engage a tubular member with opposingly biased bites (e.g., upward and downward in the case of a vertical pipe load).

The slip bowls 105, 110 may be moveably coupled to heads 115, 120 via spring mounts 125, 130, respectively. The spring mounts 125, 130 may be adapted to allow movement of the slip bowls 105, 110 over varying distances B1 and B2 with respect to the heads 115, 120, respectively. Each of the spring mounts 125, 130 may include multiple springs or spring-like mechanisms. In some embodiments, the spring mounts 125, 130 may be slidably coupled, or otherwise moveably coupled, to the slip bowls 105, 110 with one or more connectors. Each connector may have one or more springs applying a biasing force to the slip bowls 105, 110. One or more springs may be disposed with the connector on opposing sides of a mounting portion of a given slip bowl, to thereby provide opposing biasing forces on the slip bowl. In certain embodiments, the net force provided to a particular slip bowl may be slightly greater than the weight of the slip bowl. While particular examples of spring mounts 125, 130 are depicted in FIG. 1, it should be understood that alternative means of providing moveable coupling may be implemented.

The slip bowls 105 and 110 may be coupled in a spaced relation via one or more actuators. By way of example without limitation, slip bowls 105 and 110 may be coupled via a set of hydraulic cylinders 135A and 135B. Each hydraulic cylinder 135A, 135B may be connected to both slip bowls 105 and 110 with a gap 140 between the slip bowls 105, 110. A sensor 145 may be disposed in or proximate to the gap 140 to detect a change in the gap 140.

The hydraulic cylinders 135A, 135B may be adapted to apply external force to move the slip bowls 105, 110 toward each other and thereby to apply a pre-load force to engage the tubular member with a pre-load bite. Specifically, in an engaged state, the hydraulic cylinders 135A, 135B may provide the force necessary to impart a compressive force on a portion of the tubular member between the slip bowls 105, 110, with the opposing slip bowls 105, 110 engaging the tubular member with opposingly biased bites. While two hydraulic cylinders are depicted in the example of FIG. 1, it should be understood that any suitable number of hydraulic cylinders may utilized. Furthermore, the example of hydraulic cylinders should not be seen as limiting, as it should be understood that alternative means of applying external force to move the slip bowls may be utilized, include electric actuators, for example.

Figure 2:
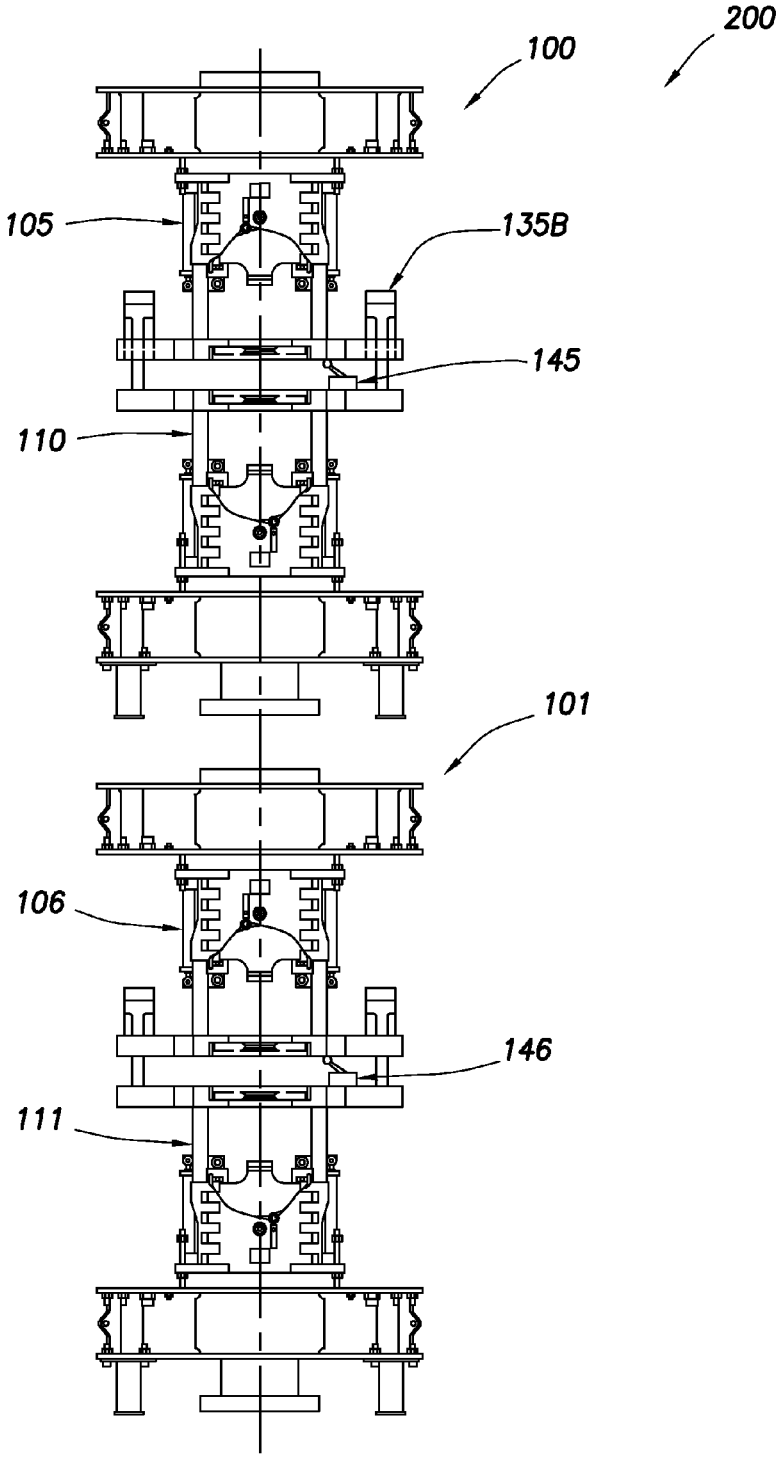
FIG. 2 is an illustration of an example slip bowl system, in accordance with certain embodiments of the present disclosure.

FIG. 2 is an illustration of one example slip bowl system 200, in accordance with certain embodiments of the present disclosure. The slip bowl system 200 may include the slip bowl assembly 100 of FIG. 1, which represents one of two sets of slip bowl assemblies in the slip bowl system 200. The slip bowl system 200 also may include slip bowl assembly 101, which may be similar to slip bowl assembly 100. Thus, the slip bowl system 200 may include two slip bowl assemblies 100, 101 with a total of four slip bowls 105, 106, 110, 111, aligned along the same longitudinal axis to conduct load transfer jacking operations. The slip bowl assemblies 100, 101 may be coupled together via any suitable jacking arrangement, including any suitable conventional jacking arrangement, that allows for the load transfer features described herein. By way of example without limitation, the slip bowl assemblies 100, 101 may be coupled together via a jacking arrangement disclosed in U.S. Pat. No. 6,688,393, which is incorporated herein by reference in its entirety for all purposes.

When transferring load between the slip bowl assemblies 100, 101, the slip bowl system 200 assures that one slip bowl assembly has control of the tubular load before allowing an operator to open the other slip bowl assembly. This feature eliminates reliance on proper execution of the load transfer verification procedure by the operator. The slip bowl system 200 applies a minimum tubular setting force on the active set of slip bowls at all times. This assures the slips have a bite on the tubular when tubular load is negligible—i.e., when crossing the balance point, or when initially running tubulars into a well for workovers. The slip bowl system 200 holds the load and prevents it from moving in both longitudinal directions (e.g., down and up in the case of a vertical well). This is advantageous when crossing the balance point or when there is a risk of sudden load reversal due to downhole conditions. This functionality reduces dependency on operator skill and dependence on procedures when crossing the balance point or while performing certain well operations that may present a risk of sudden load reversal.

Figure 3:
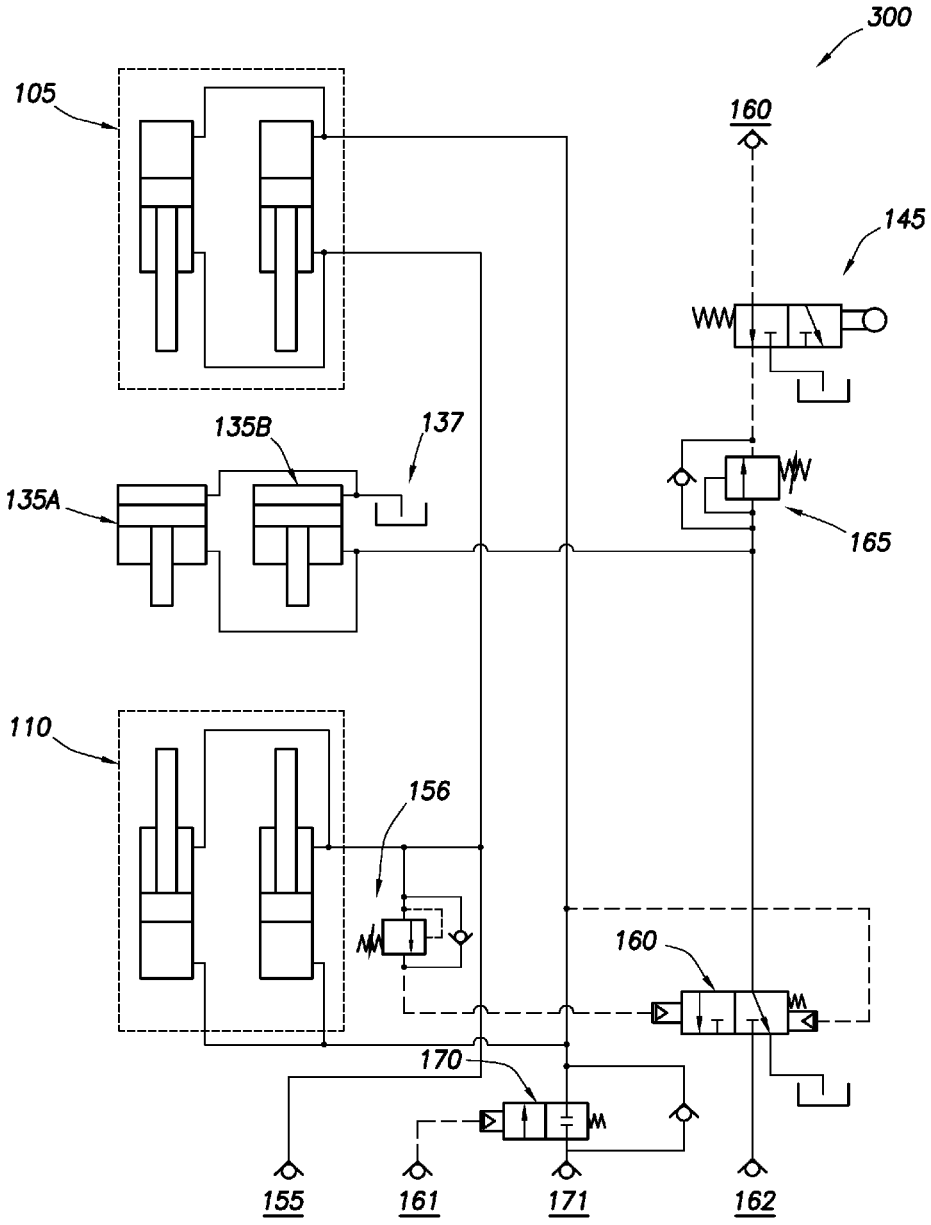
FIG. 3 is a control diagram for a slip bowl system corresponding to FIG. 2, in accordance with certain embodiments of the present disclosure.

FIG. 3 is a control diagram 300 for the slip bowl system 200, in accordance with certain embodiments of the present disclosure. In operation, after a tubular member is introduced into the slip bowls 105 and 110, the slip bowls 105, 110 are actuated to the closed position by a conventional slip control valve (not shown). In the example of FIG. 3, the corresponding slip close input 155 corresponds to the lines running to both slip bowls 105 and 110. The closed condition may be sensed by a valve 156, which may be a normally closed sequence valve, for example.

Once slip bowls 105 and 110 are closed, hydraulic cylinders 135A, 135B are actuated to force slip bowls 105, 110 together, creating a setting force. In the example of FIG. 3, the hydraulic cylinders 135A, 135B may be actuated via a valve 160. The valve 160 may be a normally closed, three-way, two-position valve, configured to sense an output of valve 156. The source 137 of the hydraulic pressure supplied to the hydraulic cylinders 135A, 135B may be independent of the slip bowl actuation pressure source 162.

The tubular member between the slip bowls 105, 110 is engaged by the slips and under compression if the slip bowls 105, 110 are functioning properly in an engaged state, where the slip bowls 105, 110 engage the tubular member with at least a minimum threshold of engaging force. However, if either slip bowl 105 or 110 does not sufficiently bite the tubular member, the distance of the gap 140 between the slip bowls 105, 110 will be decreased due to the forces of the hydraulic cylinders 135A, 135B. Thus, as a consequence of the slip bowls 105, 110 not being in an engaged state, the sensor 145 may be tripped as it detects the complete closure of the gap 140, or a lesser decrease in the gap 140 that corresponds to a predetermined threshold.

Two conditions must be met to allow the second set of slip bowls 106, 111 to be opened via a pilot signal 160 from the slip bowls 105 and 110. First, the hydraulic cylinders 135A, 135B must receive sufficient pressure to create a specific force. The sequence valve 165, being coupled to the hydraulic cylinders 135A and 135B, will trip once a specific pressure is achieved. Second, the sensor 145 must not be tripped. For example, the sensor 145 may be in the normal open position. If these conditions are satisfied, a pilot signal 160 may be transmitted to the second set of slip bowls 106, 111 to release (open) the interlock valve for the second set (not shown). The operator must still manually actuate the second set of slip bowls 106, 111 to open them.

However, if the conditions are not satisfied, the slip bowls 106, 111 will be prevented from releasing the tubular member. A pilot signal 160 will not be transmitted to open the interlock valve on the second set of slip bowls 106, 111. The operator can attempt to actuate the slip bowls 106, 111 open, but they will not open if the conditions are not satisfied.

The interlock valve for the second set of slip bowls 106, 111 may be similar to the interlock valve 170 for the first set of slip bowls 105, 110. The interlock valve 170 may be a normally closed, two-way, two-position valve with a pilot input 161 from the sensor 146 of the slip bowl assembly 101. A slip open input 171 at the interlock valve 170 will be prevented if the pilot input 161 from the sensor 146 indicates that the sensor 146 has tripped, thereby preventing the disengagement of the first set of slip bowls 105, 110 in a case where the second set of slip bowls 106, 111 has failed to properly engage a tubular. As would be understood by a person of ordinary skill in the art having the benefit of this disclosure, although not explicitly depicted, the control schema for the second set of slip bowls 106, 111 may be substantially similar to that of FIG. 3, but configured with respect to the second slip bowl assembly to provide the features disclosed herein.

The control diagram 300 is one example implementation for the slip bowl system 200. It should be understood that control of the slip bowl system 200 may be implemented with a computerized control system, which may be coupled to the slip bowl assemblies 100, 101, including the valves, the sensors, and actuators using any suitable wired or wireless connections. The computerized control system may be used to monitor and/or actuate the slip bowl assemblies 100, 101.

Accordingly, certain embodiments according to the present disclosure provide for a slip bowl load transfer system and method that improves safety for snubbing/hydraulic workover operations. Certain embodiments may be particularly advantageous in high-risk applications where there are risks to people, property and environment. Certain embodiments prevent two slip bowls for handling tubulars, such as pipe, from being actuated to the open position at the same time. Certain embodiments provide for confirmation that a load transfer has taken place before allowing another slip bowl to be opened. Certain embodiments provide improved tubular load control through the balance point of pipe tubular and the balance point zone via a preload bite on the tubular. Certain embodiments may prevent slip bite failure. Certain embodiments hold a tubular load in both longitudinal directions (e.g., up and down in the case of a vertical tubular load).

Even though the figures depict embodiments of the present disclosure in a particular orientation, it should be understood by those skilled in the art that embodiments of the present disclosure are well suited for use in a variety of orientations. Accordingly, it should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces.

What is claimed is:

1. A slip bowl load transfer system comprising:

a first slip bowl assembly adapted to engage and release a tubular member and comprising a first slip bowl coupled to a second slip bowl, wherein, in an engaged state, the first slip bowl assembly imparts a compressive force on a portion of the tubular member between the first slip bowl and the second slip bowl;

a gap formed between the first slip bowl and the second slip bowl, wherein a sensor detects a change in the gap and wherein the sensor is tripped if the gap is smaller than a predetermined threshold; and a second slip bowl assembly adapted to engage and release the tubular member and that is aligned with the first slip bowl assembly;

wherein, when the second slip bowl assembly is engaging the tubular member in a second engaged state, the second slip bowl assembly is prevented from releasing the tubular member if the sensor is tripped; and wherein the engaged state comprises engaging the tubular member with at least a minimum threshold of engaging force, wherein the minimum threshold of engaging force is a force sufficient to bite on the tubular member.

2. The slip bowl load transfer system of claim 1, wherein, in the engaged state, the first slip bowl assembly prevents the tubular member from moving in a first direction and in a second direction along a longitudinal axis of the tubular member.

3. The slip bowl load transfer system of claim 1, wherein the second slip bowl assembly comprises a third slip bowl coupled to a fourth slip bowl, wherein, in the second engaged state, the third slip bowl assembly imparts a compressive force on a second portion of the tubular member between the third slip bowl and the fourth slip bowl.

4. The slip bowl load transfer system of claim 1, wherein the first slip bowl assembly is configured to provide an indication of whether the first slip bowl assembly is in the engaged state.

5. The slip bowl load transfer system of claim 1, further comprising:

a first set of actuators coupled to the first and second slip bowls, wherein actuation of the first set of actuators provides the compressive force on the portion of the tubular member between the first and second slip bowls.

6. The slip bowl load transfer system of claim 5, further comprising:

a second set of actuators coupled to the third and fourth slip bowls, wherein actuation of the second set of actuators provides the compressive force on the second portion of the tubular member between the third and fourth slip bowls.

7. The slip bowl load transfer system of claim 5, wherein, when the first slip bowl assembly is in the engaged state, the second slip bowl assembly is prevented from releasing the tubular member if the first set of actuators is not enabled to provide the compressive force on the first portion of the tubular member between the first and second slip bowls.

8. The slip bowl load transfer system of claim 1, further comprising:

a jacking arrangement disposed between the first slip bowl assembly and the second slip bowl assembly.

9. The slip bowl load transfer system of claim 1, wherein the slip bowl load transfer system maintains the tubular member in the engaged state when running the tubular member into a well.

10. A method of transferring a load, the method comprising:

providing a first slip bowl assembly adapted to engage and release a tubular member and comprising a first slip bowl coupled to a second slip bowl, wherein a gap is formed between the first slip bowl and the second slip bowl;

using a sensor to detect a change in the gap, wherein the sensor is tripped if the gap is smaller than a predetermined threshold;

engaging the tubular with a second slip bowl assembly;

wherein the second slip bowl assembly is adapted to engage and release the tubular member and is aligned with the first slip bowl assembly, wherein, when the second slip bowl assembly is engaging the tubular member in a second engaged state, the second slip bowl assembly is prevented from releasing the tubular member if the sensor is tripped;

imparting a compressive force on a portion of the tubular member with the first slip bowl assembly in the first engaged state; and releasing the tubular member from the second slip bowl assembly, wherein the first engaged state and the second engaged state comprise engaging the tubular member with at least a minimum threshold of engaging force, wherein the minimum threshold of engaging force is a force sufficient to bite on the tubular member.

11. The method of claim 10, wherein the step of imparting the compressive force on the portion of the tubular member with the first slip bowl assembly in the engaged state comprises:

preventing the tubular member from moving in a first direction and in a second direction along a longitudinal axis of the tubular member.

12. The method of claim 11, wherein the second slip bowl assembly comprises a third slip bowl coupled to a fourth slip bowl, wherein, in the second engaged state, the third slip bowl assembly imparts a compressive force on a second portion of the tubular member between the third slip bowl and the fourth slip bowl.

13. The method of claim 11, wherein the first slip bowl assembly is configured to provide an indication of whether the first slip bowl assembly is in the engaged state and wherein the step of releasing the tubular member from the second slip bowl assembly is based, at least in part, on the indication.

14. The method of claim 11, further comprising:

providing a first set of actuators coupled to the first and second slip bowls, wherein actuation of the first set of actuators provides the compressive force on the portion of the tubular member between the first and second slip bowls.

15. The method of claim 14, further comprising:

providing a second set of actuators coupled to the third and fourth slip bowls, wherein actuation of the second set of actuators provides the compressive force on the second portion of the tubular member between the third and fourth slip bowls.

16. The method of claim 14, wherein, when the first slip bowl assembly is in the engaged state, the second slip bowl assembly is prevented from releasing the tubular member if the first set of actuators is not enabled to provide the compressive force on the first portion of the tubular member between the first and second slip bowls.

17. The method of claim 10, further comprising:

providing a jacking arrangement coupling the first slip bowl assembly and the second slip bowl assembly.

* * * * *